US005589863A

United States Patent [19]

Janse Van Rensburg et al.

[11] Patent Number: 5,589,863

[45] Date of Patent: Dec. 31, 1996

[54] INK JET DROPLET GENERATOR

[75] Inventors: Richard W. Janse Van Rensburg; Peter R. Keep, both of Cambridge, United Kingdom

[73] Assignee: Videojet Systems International, Inc., Hertfordshire, United Kingdom

[21] Appl. No.: 325,325

[22] PCT Filed: Feb. 22, 1994

[86] PCT No.: PCT/GB94/00348

§ 371 Date: Dec. 20, 1994

§ 102(e) Date: Dec. 20, 1994

[87] PCT Pub. No.: WO94/19195

PCT Pub. Date: Sep. 1, 1994

[30] Foreign Application Priority Data

Feb. 24, 1993 [GB] United Kingdom ..... 9303703

[51] Int. Cl.[6] ..... B41J 2/02

[52] U.S. Cl. ..... 347/75

[58] Field of Search ..... 347/20, 68, 74, 347/75

[56] References Cited

U.S. PATENT DOCUMENTS 4,779,099 10/1988 Lewis ..... 347/20

FOREIGN PATENT DOCUMENTS

| | | | |
|---|---|---|---|
| 22254A1 | 7/1980 | European Pat. Off. . | |
| 12830694 | 2/1979 | Germany . | |
| 13009685 | 10/1980 | Germany . | |
| 13227638 | 2/1983 | Germany . | |
| 56-13176 | 2/1981 | Japan | 347/75 |
| 4-52143 | 2/1992 | Japan | 347/75 |
| 1559651 | 1/1980 | United Kingdom . | |
| 2044179 | 10/1988 | United Kingdom | 347/75 |

*Primary Examiner*—John E. Barlow, Jr.
*Attorney, Agent, or Firm*—Donald C. Casey

[57] ABSTRACT

An ink jet droplet generator is described, including a nozzle plate bonded to a carrier. A tuned piezo crystal and metal structure projects into an ink cavity and is mounted on a print head structure. The nozzle carrier is separated by a spacer from the print head structure and seals are provided to seal the cavity. A pillar is provided with a height slightly greater than that of the spacer between the print head structure and the nozzle carrier. The spacer is isolated from the print head structure, pillar and nozzle carrier by seals and O-ring which surrounds the pillar. In another embodiment, layers of acoustically absorbent material are provided between the spacer and each of the print head structure and nozzle element.

21 Claims, 2 Drawing Sheets

INK JET DROPLET GENERATOR

The present invention relates to an Ink Jet Droplet Generator such as a droplet generator which is suitable for use in an ink jet printer.

In conventional continuous jet, multi-jet, ink jet printers, an array of jets is produced by forcing ink, under pressure, through closely spaced nozzles from a common ink-filled cavity behind the nozzles. These jets are caused to break up into uniform streams of drops by imposing a periodic disturbance on all of the jets.

it is advantageous if the time taken to form the drops from each continuous jet is as uniform as possible across the whole array of jets. It is also preferable that no small "satellite" drops are formed between the main drops.

Often, the disturbance is introduced by positioning a regularly vibrating element, such as a piezo crystal, somewhere in the print head structure so that the vibration is transmitted through the material used to construct the nozzle, the nozzle mounting, the ink supply manifold, and also (through the ink) to the jets.

Factors which affect the creation of "satellites" and the uniformity of drop formation across the array include the geometry of the cavity behind the nozzle, the acoustic properties of the materials used to construct the ink manifold and nozzle, and the way in which the separate components of the print head are connected together.

A known ink jet droplet generator comprises a print head structure, a cavity for ink, an ink nozzle element spaced from the print head structure by a spacing or sidewall element providing a sidewall for the cavity between the print head structure and the nozzle element. The spacing element is fixedly clamped between the print head structure and the ink nozzle element.

It is the purpose of the spacing element in the prior art to ensure that the distance from the print head structure, which includes a tuned piezo crystal, to the nozzle element is correct so that the shape and dimensions of the cavity behind the nozzle provide a disturbance at the jets which is of adequate magnitude and uniformity.

However, to ensure that a proper cavity geometry is provided and that the acoustic performance is as constant as possible, relatively large surfaces of the spacer have to make contact with the print head structure on one side and the nozzle element on the other side.

There are problems with this approach.

The performance of the ink jet generator varies merely by removing and replacing the nozzle or by slightly changing the tightness of the bolts. This is undesirable.

The present invention aims to at least alleviate these problems.

According to a first aspect of the present invention, there is provided an ink jet droplet generator comprising a print head structure, a cavity for ink, an ink nozzle element spaced from the print head structure, a cavity sidewall element providing a sidewall for the cavity between the print head structure and the nozzle element, characterised by coupling means for setting the distance between the print head structure and the nozzle element.

This provides a significantly improved droplet generator. The variation in a periodic disturbance transmitted through the structure is significantly reduced, yet the geometry of the ink cavity is maintained and acoustic energy is retained within the cavity.

Preferably, the droplet generator includes a layer of acoustically absorbent material located between the sidewall element and one of the print head structure and the nozzle element.

According to a second aspect of the present invention, there is provided an ink jet droplet generator comprising a print head structure, a cavity for ink, a nozzle element spaced from the print head structure, and a layer of acoustically absorbent material located adjacent to an internal surface of one of the nozzle element and the print head structure.

The layer of acoustically absorbent material has the advantage that the inherent acoustic decoupling across the layer improves the acoustic performance of the droplet generator.

Preferably, the droplet generator includes a cavity sidewall element providing a sidewall for the cavity between the print head structure and the nozzle element.

In preferred embodiments in accordance with either aforementioned aspect of the invention, the droplet generator may be embodied advantageously in the following ways.

The sidewall element may be separate from the print head structure and the nozzle elements.

Preferably, the sidewall element includes a surface (upper or lower) which is located adjacent to one of the print head structure and the nozzle element. Preferably, the coupling means includes a coupling element which is clamped between the said one of the print head structure and the other, so that the surface of the sidewall element is spaced from the adjacent one of the print head structure and the nozzle element. However, it is envisaged that one or more relatively small-surfaced coupling elements could be employed, clamped between the surface of the sidewall and one of the print head structure and nozzle, either separate from or integral with the sidewall (or the print head structure or nozzle element), to achieve a similar spacing for the sidewall surface.

In a particularly advantageous embodiment, the print head structure is secured to the nozzle element with a bolt and the coupling means is provided in the form of a coupling element such as an annular pillar through which the bolt passes. In addition to determining the distance between the generator body and nozzle mount such coupling means can ensure good acoustic contact between these two elements.

The coupling means may pass through a bore in the sidewall element, and the coupling means and sidewall element may be spaced apart by an acoustic isolator, such as an elastomeric material O-ring. This provides a particularly advantageous structure because the droplet generator may be arranged with only relatively small surface areas of the print head structure and the nozzle element in contact with relatively small end surfaces of the pillar. Thus, the structure is not so intolerant of imperfect mating surfaces and more consistent performance is achieved if, for example, the nozzle element is replaced or the tightness of the bolt is changed slightly.

In one embodiment, the coupling means is provided in the form of a rigid element such as stainless steel collar-shaped pillar; it is envisaged that other materials could be employed. This may be located between the print head structure and the nozzle element, the height of the rigid element defining the spacing between the print head structure and the nozzle element. The coupling means may be located outside the ink cavity, and may also be sealed against the ingression of dirt from outside the droplet generator.

Preferably, the sidewall element includes an upper surface and a lower surface and the distance between the upper and lower surfaces is less than the height of the coupling means, so that the sidewall element is retained loosely between the print head structure and the nozzle element. The sidewall element may have a height of about 4 millimeters and the coupling means may be less than a millimeter, for example 200 μm, taller in the same dimension. This produces only a small gap between the sidewall element and one or each of the print head structure and the nozzle element. Therefore, this retains proper geometry in the ink cavity.

Preferably, the sidewall element is acoustically isolated from both of the print head structure and the nozzle element.

in order to seal the ink cavity, an ink seal may be provided between the sidewall element and one of the print head structure and the nozzle element. A first ink seal may be provided between the sidewall element and the print head structure and a second seal may be provided between the sidewall element and the nozzle element. This is advantageous in that the first and second seals may serve to hold the sidewall element resiliently in position whilst maintaining its acoustic isolation from each of the print head structure and the nozzle element.

The layer of acoustically absorbent material is preferably elastomeric and may comprise a sheet gasket constituting one said ink seal which is located between the sidewall element and one of the print head structure and nozzle element. Preferably both ink seals comprise such a sheet gasket.

Preferably the sheet gasket is of resiliently compressible elastomeric material. Thus, when the print head structure is secured to the nozzle element, particularly effective sealing of the ink cavity is achieved.

In a preferred embodiment, the sheet gasket is approximately 150 μm thick and is arranged to compress to approximately 100 μm thick when the print head structure is secured to the nozzle element.

In one embodiment, the sheet gasket fills substantially the entire space between facing surfaces of the sidewall element and one of the print head structure and nozzle element. The facing surfaces may be parallel planar surfaces. The coupling means may pass, through an aperture in the gasket, from the sidewall element to one of the print head structure and the nozzle element.

The droplet generator may include a first sheet gasket between the sidewall element and the print head structure and a second sheet gasket between the sidewall element and the nozzle element.

The droplet generator may, therefore, be configured in a layered configuration consisting, in order, of the print head structure, one sheet gasket, the sidewall element, another sheet gasket, and the nozzle element. This provides a simple structure with a high level of acoustic performance.

In another embodiment, the layer of acoustically absorbent material comprises a coating layer attached to the sidewall element preferably to the upper or lower surface thereof. The coating may be approximately 50 μm thick. Preferably, the coating layer covers substantially all of the upper (or lower) surface of the sidewall element.

It is envisaged that, with or without the coating layer or the sheet gasket, the droplet generator may include an O-ring for sealing the ink cavity. As explained above for the sheet gasket, two coating layers and/or two O-rings could be used, with one above and one below the sidewall element.

in one embodiment, an arrangement of an O-ring integral with the coating or gasket layer may be used to seal the ink cavity.

Preferably the print head structure comprises an ink manifold within which a disturbance generator is mounted. Preferably, the disturbance generator includes a tuned piezo crystal. It is also preferred that the nozzle element comprises a nozzle plate including a series of spaced ink discharge nozzles.

In another embodiment, the bolts for connecting the print head structure and nozzle element could be replaced by C-shaped clips or similar fasteners.

Another advantage of the present invention is that it provides improved streams of ink droplets in which the tendency to form small "satellite drops" is substantially reduced.

The present invention may be carried out in various ways and embodiments of ink jet droplet generators in accordance with the invention will now be described by way of example with reference to the accompanying drawings, in which.

Figure 1A:
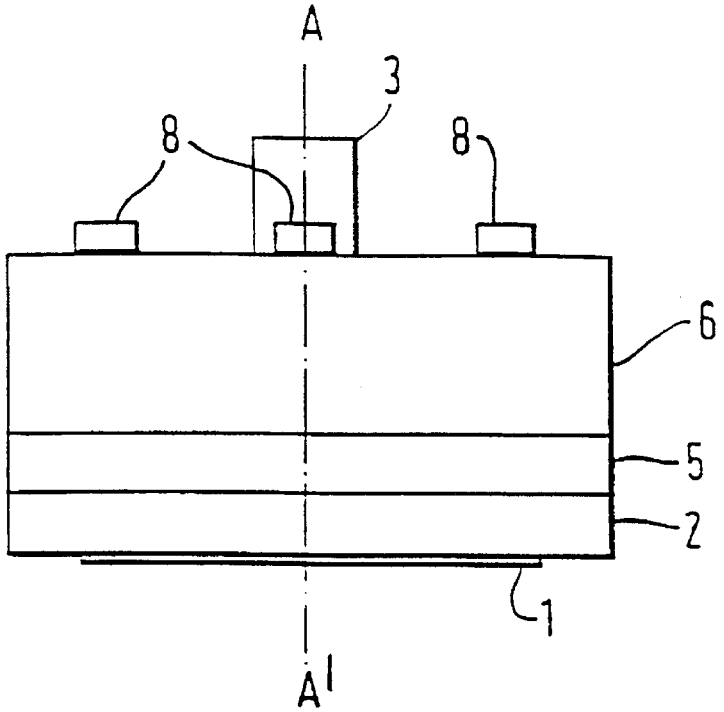
FIG. 1A (PRIOR ART)
FIG. 1A is a side elevation of a conventional ink jet droplet generator which forms part of the state of the art.
Figure 1B:
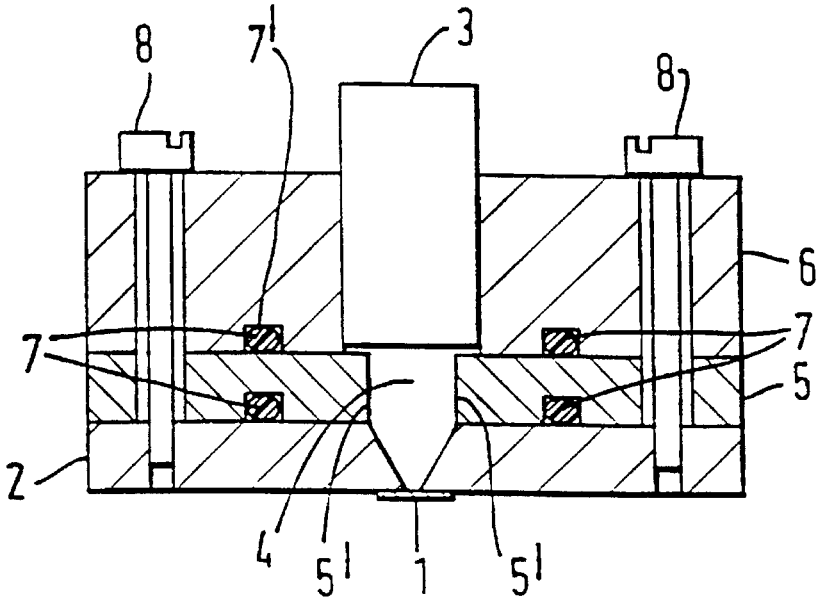
FIG. 1B (PRIOR ART)
FIG. 1B is a section on line A—A' of FIG. 1A.

As FIGS. 1A and 1B show, a conventional ink jet droplet generator includes a nozzle plate 1 which is bonded permanently in some way (for example by glue, solder, welding or by constructing the component from a single piece of material) to a carrier 2.

A tuned piezo crystal and metal structure or load rod 3 projects into an ink cavity 4.

The nozzle carrier is separated by a generally flate spacer 5, from an ink manifold forming a print head structure 6, the spacer forming a sidewall 5' of the ink cavity 4.

Soft seals 7 are placed above and below the spacer, seated in grooves 7' in the print head structure 6 and spacer 5 to ensure that the pressurized ink does not leak through gaps between the spacer, the print head structure and the nozzle carrier.

The print head structure, spacer and nozzle carrier are held together by appropriate bolts 8 which mate with threads in the nozzle carrier.

Figure 2:
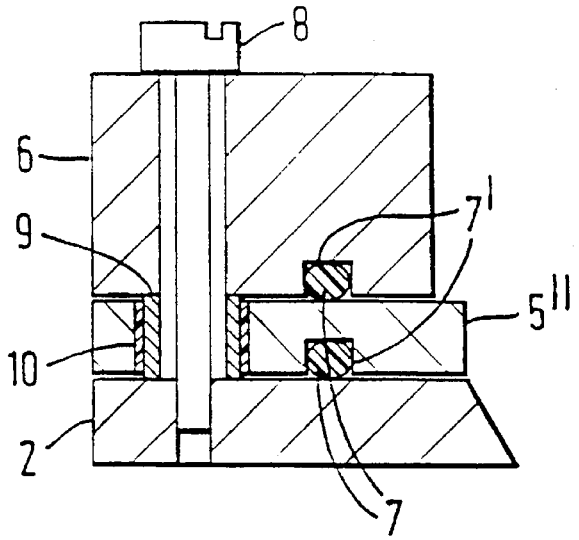
FIG. 2 is a part side section of an embodiment of an ink jet droplet generator in accordance with the present invention.
Figure 3:
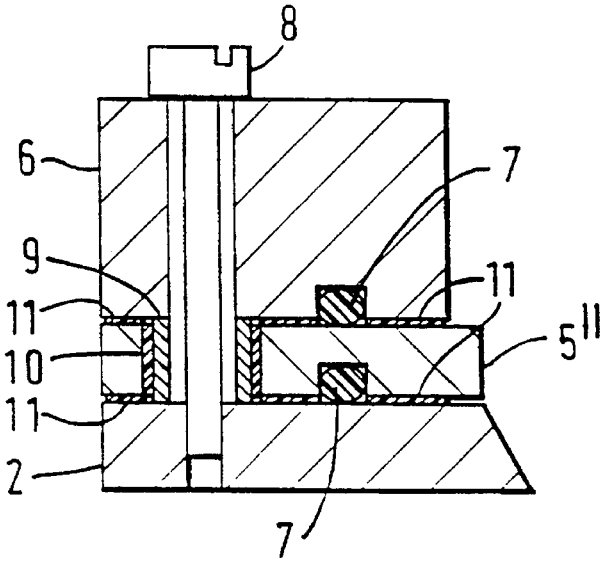
FIG. 3 is a part side section of a second embodiment of an ink jet droplet generator in accordance with the present invention.
Figure 4:
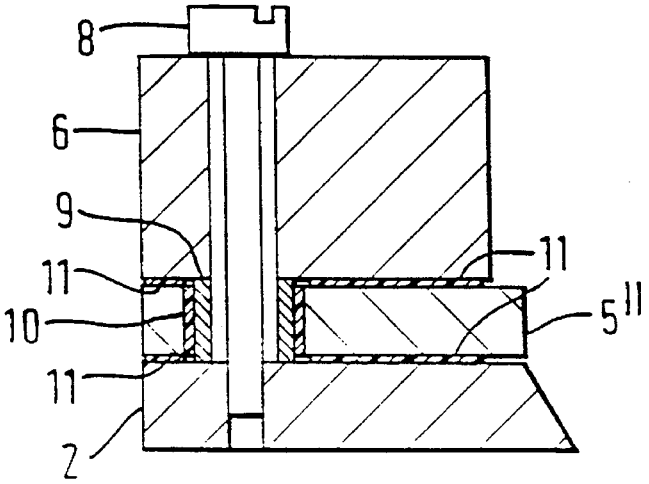
FIG. 4 is a part side section of a third embodiment of an ink jet droplet generator in accordance with the present invention.

As FIGS. 2 to 4 show, the problems of the arrangement of FIGS. 1A and 1B, caused partly because large areas of mating surfaces are in contact with one another, are substantially reduced in the present invention. In FIGS. 2 to 4, except where otherwise indicated, reference numerals have been used to indicate similar parts to those in FIGS. 1A and 1B.

In the example shown in FIG. 2, pillars 9 fit as collars around the bolts 8. The pillars 9 are of stainless steel, but is it envisaged that other materials could be employed.

In FIG. 2, the spacer 5 of FIGS. 1A and 1B has been substituted by an element of similar appearance but which no longer acts as a spacer to set the distance between the print head structure 6 and the nozzle carrier 2, and which will therefore be referred to as a cavity sidewall element 5" for the ink cavity 4.

The pillars 9 are taller than the sidewall element 5" by about 200 μm so that only the pillars and seals 7 make contact with the print head structure 6 and the nozzle carrier 2. This separates the relatively uneven surfaces of the sidewall element 5" and each of the print head structure 6 and the nozzle carrier 2 and hence removes much of the sources for inconsistencies in performance, Now, it is the pillars 9 which act as a spacer to set the distance between the print head structure 6 and the nozzle carrier 2. The small contact areas between the pillars 9 and the nozzle carrier 2 (and the print head structure 6) ensure that relatively uneven contacting surfaces are not detrimental to performance. Preferably, the total contact area provided by all of the pillars 9 is substantially smaller than the area of the facing surfaces of the sidewall element 5" and each one of the nozzle carrier 2 and print head structure 6.

Appropriate sealing material such as a rubber O-ring 10 is provided between each pillar 9 and the sidewall element 5". This acts to isolate the sidewall element 5" from the pillars 9. The sidewall element 5" is thus resiliently held in place by the seals 7 and the O-rings 10.

The amount of variation in the disturbance transmitted through the structure is much smaller than in previous ink jet droplet generators, while the geometry and proper conditions for transmitting acoustic energy within the cavity are retained.

In the embodiment of FIG. 4, a different arrangement for retaining ink in the ink cavity 4 is employed. Instead of the seals 7 and grooves 7', gaskets 11 are located between the print head structure 6 and the sidewall element 5" and between the sidewall element 5" and the nozzle carrier.

Each gasket 11 comprises a sheet of compressible gasket material. Each gasket is preferably about 150 μm thick. Since the pillars 9 are approximately 200 μm taller than the sidewall element 5", when the bolts 8 are tightened, the gaskets (300 μm in combined thickness) compress to seal the ink cavity and hold the sidewall element in position.

Each gasket 11 fills ,substantially the entire space between the facing surfaces of the sidewall element 5" and each of the print head structure 6 and nozzle carrier 2 respectively. Thus, each gasket may have apertures formed therein through which the bolts 8 and pillars 9 pass in the assembled state.

It will be understood that this arrangement is particularly convenient. It is advantageous in that it provides a way of holding the sidewall element 5" over a large surface area giving good acoustic performance to the droplet generator. It is also easy to assemble. The space between the sidewall element 5 and each of the print head structure 6 and nozzle carrier 2, which would otherwise contain ink or air, is filled with gasket material. As well as providing an effective seal, this has the advantage that the position of the sidewall element is controlled, ensuring that the metal surfaces of the print head structure 6 and the nozzle carrier 2 do not contact one another. Also, air (or liquid such as ink) cannot be trapped between the sidewall element 5, print head structure 6 and nozzle carrier 2 in an uncontrolled way to affect acoustic performance adversely.

Preferably, the gaskets are formed from resiliently compressible material, such as elastomeric material. Thus, the sidewall element 5" can be held in position resiliently.

In the embodiment of FIG. 3, sheet gaskets 11 are employed again, but the seal 7 and groove 7' arrangement is also used. Thus, gaskets 11 may be used with or without the seals 7. When seals 7 and gaskets 11 are used, they may be integral with one another. Conveniently, the seals 7 may be O-rings.

As an alternative to using gaskets 11, the sidewall element 5" may be coated on at least its upper and lower surfaces with acoustically absorbent elastomeric material layers (not shown).

Although ink may enter spaces between the sidewall element 5" and the print head structure 6 and/or the nozzle carrier 2, the acoustically absorbent nature of the coating ensures that vibrations are not transmitted undesirably through the sidewall element 5". A coating as thin as 50 μm has been found effective. In this embodiment (not shown) seals 7 and grooves 7' like those shown in FIGS. 2 and 3 may be used.

We claim:

1. An ink jet droplet generator comprising a print head structure, a cavity for ink, an ink nozzle carrier spaced from the print head structure, a cavity sidewall element providing a sidewall for the cavity between the print head structure and the nozzle carrier further comprising: coupling means for acting as a spacer to set the distance between the print head structure and the nozzle carrier, said means being taller than the sidewall element so that only said coupling means makes contact between said print head structure and said nozzle carrier, the total contact area provided by said coupling means being smaller than the area of the facing surfaces of the sidewall element and each of said nozzle carrier and print head structure.

2. An ink jet droplet generator as claimed in claim 1 wherein the sidewall element is separate from the print head structure and nozzle carrier.

3. An ink jet droplet generator as claimed in claim 1 wherein the print head structure is secured to the nozzle carrier by a bolt, and the coupling means comprises an annular pillar through which the bolt passes.

4. An ink jet droplet generator as claimed in claim 1 wherein the coupling means passes through a bore in the sidewall element, and in which the coupling means and the sidewall element are spaced apart by an acoustic isolator.

5. An ink jet droplet generator as claimed in claim 4 wherein the acoustic isolator comprises an elastomeric material O-ring.

6. An ink jet droplet generator as claimed in claim 1 wherein the coupling means comprises a rigid stainless steel element located between the print head structure and the nozzle, carrier the height of the rigid element defining the spacing between the print head structure and the nozzle element.

7. An ink jet droplet generator as claimed in claim 1 wherein the sidewall element includes an upper surface and a lower surface, the distance between the upper and lower surfaces being less than the height of the coupling means.

8. An ink jet droplet generator as claimed in claim 1 further comprising an ink seal between the sidewall element and one of the print head structure and the nozzle carrier.

9. An ink jet droplet generator as claimed in claim 1 wherein the print head structure comprises an ink manifold and a disturbance generator mounted therein.

10. An ink jet droplet generator as claimed in claim 1 further comprising a layer of acoustically absorbent material disposed between the sidewall element and one of the print head structure and nozzle carrier.

11. An ink jet droplet generator as claimed in claim 10 wherein the layer of material comprises a sheet gasket forming an ink seal.

12. An ink jet generator as claimed in claim 11 wherein the sheet gasket is normally approximately 150 μm thick and compresses to approximately 100 μm thick when the print head structure is secured to the nozzle carrier.

13. An ink jet droplet generator as claimed in claim 11 wherein the sheet gasket fills substantially the entire space between facing surfaces of the sidewall element and one of the print head structure and the nozzle carrier.

14. An ink jet droplet generator as claimed in claim 11, wherein the sheet gasket includes an aperture, and the coupling means extends through the aperture between the sidewall element and one of the print head structure and nozzle carrier.

15. An ink jet droplet generator as claimed in claim 11 further comprising a first said sheet gasket between the sidewall element and the print head structure and a second said sheet gasket between the sidewall element and the nozzle carrier.

16. An ink jet droplet generator as claimed in claim 10 wherein the layer of material comprises a coating on at least one of the upper and lower surfaces of the sidewall element.

17. An ink jet droplet generator as claimed in claim 16 wherein the coating layer is approximately 50 μm thick.

18. An ink jet droplet generator as claimed in claim 16 wherein the coating layer covers substantially all of a surface of the sidewall element which faces one of the print head structure and the nozzle carrier.

19. An ink jet droplet generator as claimed in claim 1 further comprising an O-ring means for sealing the ink cavity.

20. An ink jet droplet generator as claimed in claim 19 further comprising an O-ring integral with the layer of material.

21. An ink jet droplet generator as claimed in claim 1 wherein the coupling means is located outside the ink cavity.

* * * * *